United States Patent [19]

Robards, Jr. et al.

[11] Patent Number: 4,846,461

[45] Date of Patent: Jul. 11, 1989

[54] FOOT PEDAL ASSEMBLY FOR AN EXERCISE MACHINE

[75] Inventors: Chester F. Robards, Jr., Roselle; George Kolomayets, Chicago, both of Ill.

[73] Assignee: Bally Manufacturing Corporation, Chicago, Ill.

[21] Appl. No.: 181,767

[22] Filed: Apr. 15, 1988

[51] Int. Cl.[4] ..... A63B 69/06

[52] U.S. Cl. ..... 272/72; 272/145

[58] Field of Search ..... 272/72, 93, 96, 97, 272/145, 144, 130, 73, DIG. 4; 74/594.6; 128/25 R

[56] References Cited

U.S. PATENT DOCUMENTS 4,723,774 2/1988 Monforte ..... 272/72

4,756,523 7/1988 Rasmussen ..... 272/72

*Primary Examiner*—Richard J. Apley

*Assistant Examiner*—S. R. Crow

*Attorney, Agent, or Firm*—Jenner & Block

[57] ABSTRACT

A foot pedal assembly for an exercise machine. The foot pedal assembly includes a foot pedal or base having a longitudinally extending upper surface on which the user's foot rests and a strap the ends of which are coupled to opposite sides of the foot pedal so that the strap extends horizontally across the pedal in a position to maintain the user's foot in place. One end of the strap is coupled to a rotatable, square shaft which extends longitudinally, adjacent to a portion of one side of the foot pedal. The square shaft extends through an aperture in a knob with a one-way clutch being disposed between the shaft and the knob. The one-way clutch engages when the knob is rotated in a first direction to transmit rotation to the shaft to wind the strap thereabout tightening it about the user's foot. A release lever is hinged at one end to the foot pedal and extends horizontally underneath the foot pedal and square shaft. The release lever has a blocker mounted thereon which abuts a portion of the square shaft to block rotation of the shaft in the direction opposite to the first. When the release lever is depressed, the blocker is moved out of the path of rotation of the shaft to allow the shaft to be rotated in the second direction, unwinding the strap to loosen it.

7 Claims, 4 Drawing Sheets

FIG. 7
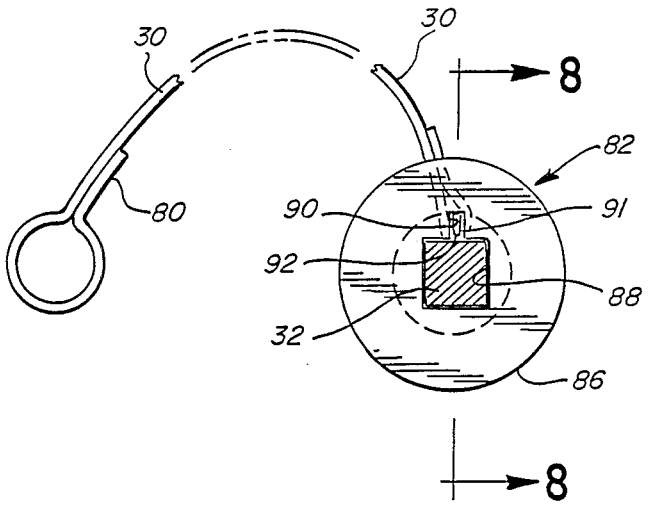
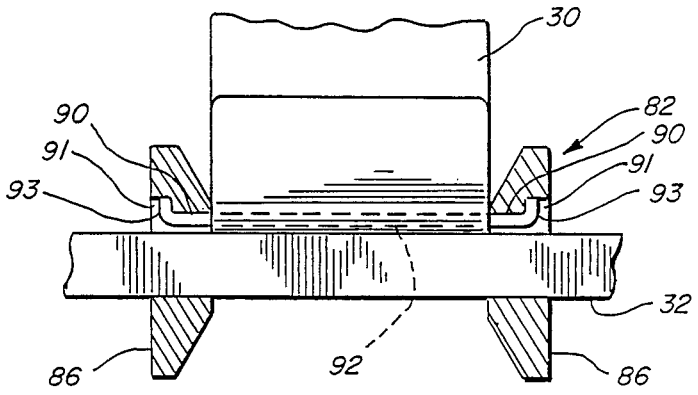
FIG. 8

FOOT PEDAL ASSEMBLY FOR AN EXERCISE MACHINE

TECHNICAL FIELD

The present invention relates to a foot pedal assembly for an exercise machine and more particularly to such an assembly for securely maintaining a user's foot in place while the user operates the exercise machine.

BACKGROUND OF THE INVENTION

Many exercise machines require that the user's feet be securely held while the user is operating the machine. For example, known rowing exercise machines typically include an elongated rail, a seat which is movable along the rail and a pair of stationary foot pedal assemblies disposed on opposite sides of the rail. To use the exercise machine, a user sits upon the seat with legs bent and feet secured in the foot pedal assemblies. The user then grasps an exercise handle and pulls back on the handle while extending his legs, moving the seat back along the rail by pushing against the foot pedals. This is known as the power portion of a rowing stroke. To return to the starting position, the user extends his arms and bends his knees moving the seat along the rail toward the foot pedals, this portion of the stroke being called the return portion. During both the power portion and the return portion of a stroke, considerable forces act on the foot pedal assemblies which can cause the user's feet to slip out of the assemblies.

Known foot pedal assemblies have included a foot pedal or base on which the user's foot rests and a strap which is held in place about the user's foot by a Velcro fastener or the like. Although such assemblies are easily adjusted to accommodate feet of different sizes, they are not always effective in retaining the user's foot especially during vigorous use of the machine. Further, such assemblies frequently do not restrain the user's foot securely enough to prevent painful chafing of the foot.

SUMMARY OF THE INVENTION

It is therefore an object of the invention to provide an exercise machine foot pedal assembly which securely holds the user's foot in place during an exercise while being easily adjustable to accommodate feet of different sizes.

The exercise machine foot pedal assembly of the present invention includes a foot pedal having a longitudinally extending upper surface on which the user's foot rests and a strap, the ends of which are coupled to opposite sides of the foot pedal so that the strap extends horizontally across the upper surface of the pedal in a position to maintain the user's foot in place. More particularly, one end of the strap is coupled to a rotatable shaft which extends longitudinally, adjacent to a portion of one side of the foot pedal. To facilitate connection of the strap, the shaft can be configured in a noncircular shape such as a square or hexagon. The shaft extends through an aperture in a knob which may be rotated in either a clockwise or counterclockwise direction. A one-way clutch is also disposed within the aperture between the shaft and the knob. The one-way clutch engages when the knob is rotated in a first direction to transmit rotation to the shaft to wind the strap thereabout, tightening the strap. When the knob is rotated in the opposite direction however, the one-way clutch disengages so that no rotation is imparted to the shaft. A release lever is hinged at one end to the foot pedal and extends horizontally underneath the foot pedal and shaft. The release lever has a blocker mounted thereon which abuts a portion of the shaft to block rotation of the shaft in the second direction, opposite to the first so that the strap is maintained wound tightly about the shaft. When the release lever is pushed down however, the blocker is moved out of the path of rotation of the shaft to allow the shaft to be rotated in the second direction unwinding the strap to loosen it.

The one-way clutch allows the strap to be easily tightened about the user's foot but in conjunction with the blocker prevents rotation of the shaft and thus loosening of the strap while the exercise machine is in use. The strap is maintained by the blocker and shaft securely tightened about the user's foot, withstanding considerable forces acting against it during an exercise while the one-way clutch prevents inadvertent loosening of the strap by rotation of the knob. The foot pedal assembly of the present invention is extremely reliable and adds considerably to the safety of the exercise machine on which it is used.

BRIEF DESCRIPTION OF THE DRAWINGS

FIG. 7 is an end view of the strap and a strap anchor according to a second embodiment of the invention;

FIG. 8 is a cross-sectional view taken along lines 8—8 of FIG. 7;

DETACHED DESCRIPTION OF THE INVENTION

Figure 1:
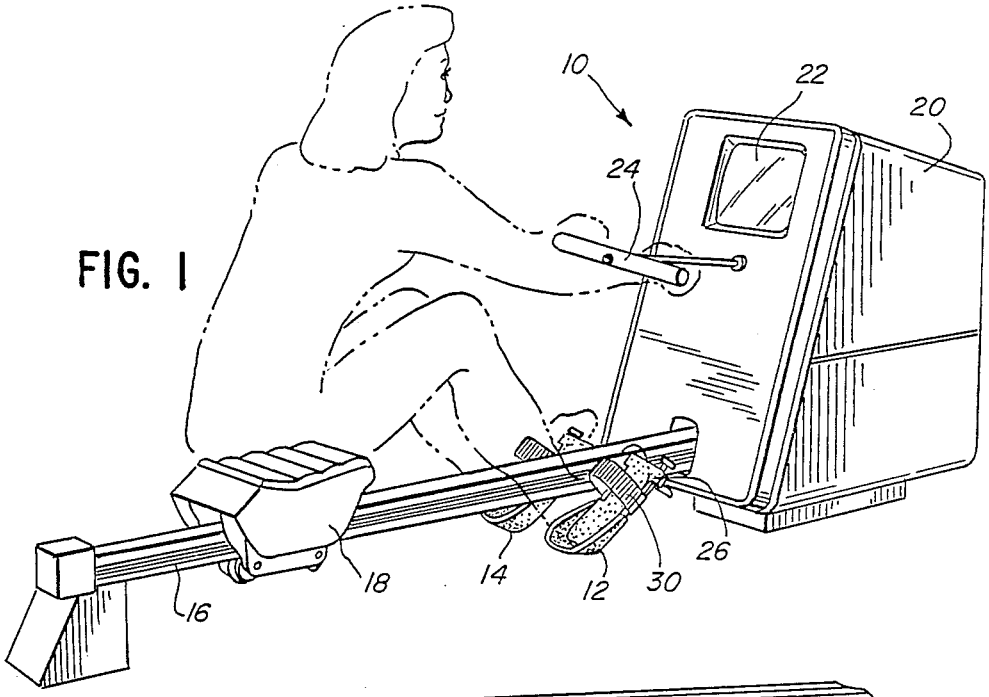
FIG. 1 is a perspective view of a rowing exercise machine employing the foot pedal assembly of the present invention.

The foot pedal assembly of the present invention may be used on a rowing exercise machine 10 as shown in FIG. 1 or on any exercise machine in which the user's foot must be held securely in place during the operation of the machine. It should be appreciated that the general foot restraint arrangement shown in FIG. 1 could be used to restrain other portions of the human anatomy such as arms and legs in an exercise machine. The rowing machine 10 includes two stationary foot pedal assemblies 12 and 14 fixedly mounted to opposite sides of an elongated rail 16 on which a movable seat 18 is also mounted. The rail 16 extends from a cabinet 20 housing a CRT display 22 and the mechanics and electronics necessary to provide a force which acts against the user as the user pulls an exercise handle 24 out from the cabinet.

To use the rowing exercise machine 10, a user sits upon the seat 18 with legs bent and feet secured in the foot pedal assemblies as shown. The user grasps the handle 24 and pulls it away from the cabinet 20 while extending his/her legs, moving the seat back along the rail by pushing against the foot pedals 12 and 14. This portion of a rowing stroke is known as the power portion. To return to the starting position, the user extends his/her arms and bends his/her knees moving the seat along the rail towards the cabinet 20. During both the power portion and return portion of the stroke, considerable forces act to pull the user's feet out of the foot pedal assemblies. Because a user may not be able to perform the exercise properly if his/her feet come loose from the foot pedal assemblies while the user is exercising, the assemblies 12 and 14 must be able to withstand these forces to securely maintain the user's feet on the pedals.

Figure 2:
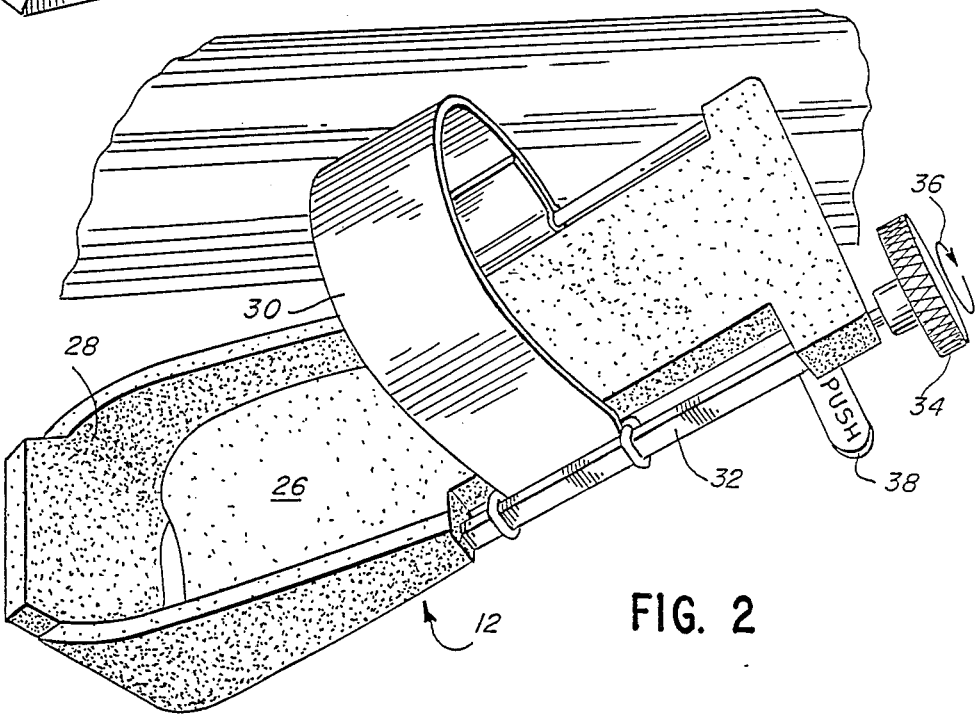
FIG. 2 is a perspective view of a foot pedal assembly according to a first embodiment of the present invention.

Each foot pedal assembly according to a first embodiment of the present invention, as shown for assembly 12 in FIG. 2, includes a base or foot pedal 26 upon which the user's foot rests. The foot pedal 26 is made of cast aluminum having an upstanding portion 28 against which the back of the user's heel rests. The user's foot is held in place on the foot pedal 26 by a strap 30 which is attached to a shaft 32 coupled to the pedal. To tighten the strap about the user's foot, the user rotates a knob 34 in the direction of an arrow 36, shown in FIG. 4 to be the counterclockwise direction, to engage a one-way clutch which transmits the rotation of the knob 34 to the shaft 32. As the shaft 32 is thus rotated, the strap 30 is wound thereabout, tightening the strap about the user's foot to maintain it securely in place on the foot pedal 26. To loosen the strap 30, a release lever 38 is pushed down, allowing the shaft to rotate in the clockwise direction so that the user may slip his foot out of the strap.

Figure 4:
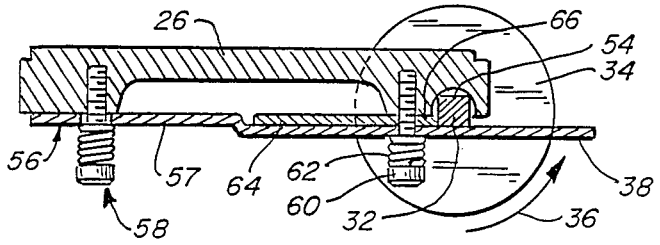
FIG. 4 is a cross section of the foot pedal assembly taken along lines 4—4 of FIG. 3.
Figure 3:
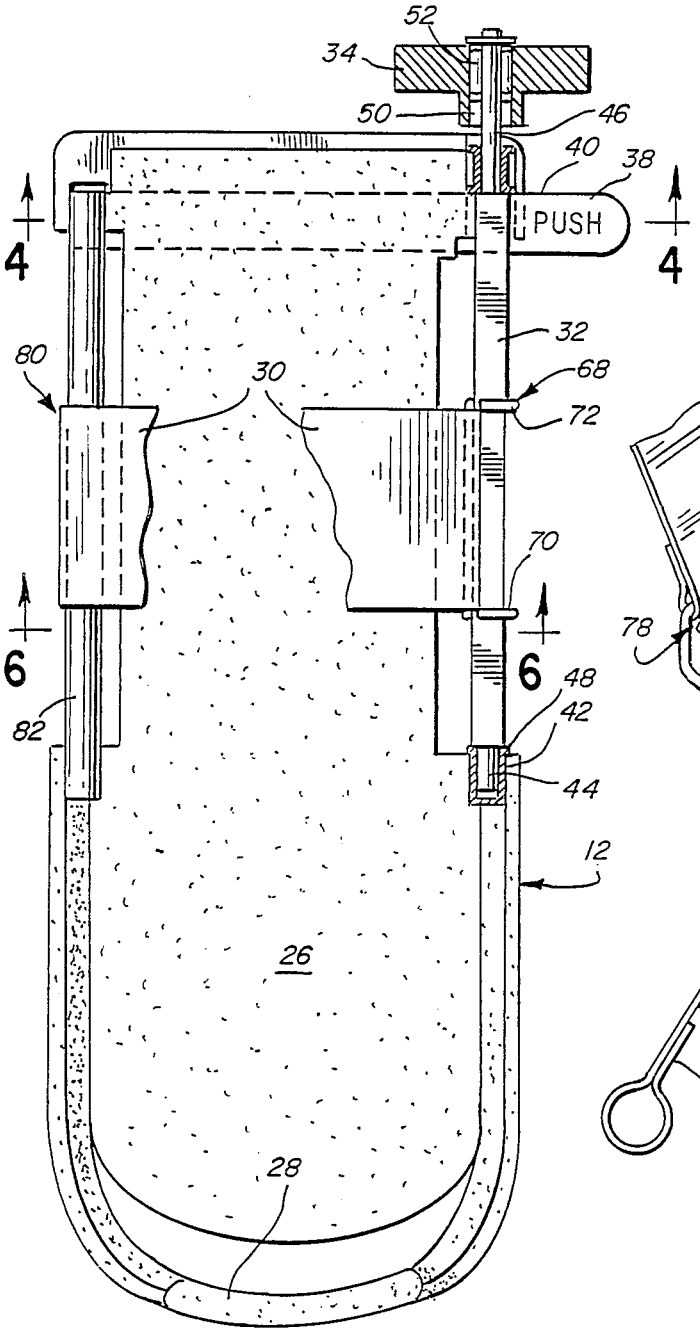
FIG. 3 is a top view, partially in cross section, of the foot pedal assembly of FIG. 2.
Figure 5:
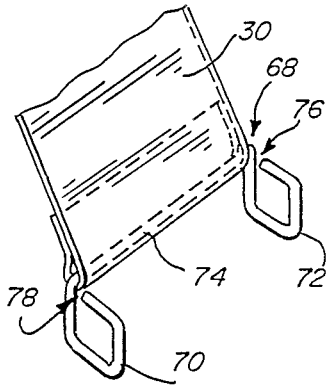
FIG. 5 is a perspective view of the strap anchor shown in FIG. 3.

As shown in greater detail in FIGS. 3–5, the main portion of the shaft 32, extending from the upper edge 40 of the release lever 38 to an aperture 42 in the foot pedal 26, is square, the shaft 32 having cylindrically shaped ends 44 and 46. The cylindrical end 44 is inserted into a bushing 48 contained in the aperture 42 of the foot pedal 26 so as to be allowed to rotate therein. The other cylindrically shaped end 46 extends through an aperture 50 in the knob 34, the aperture containing the one-way clutch 52 which transmits rotation from the knob 34 to the shaft 32 when the knob is rotated in the counterclockwise direction. When the knob 34 is rotated in the clockwise direction, the one-way clutch 52 disengages to allow the knob to rotate freely without imparting rotation to the shaft 32.

As shown in FIG. 4, the foot pedal 26 in an underneath surface has an aperture 54 through which the square shaft 32 extends. The release lever 38 is formed of a metal plate 57 hinged at one end 56 to the foot pedal 26 by a spring and screw assembly 58 so that the lever extends horizontally underneath the foot pedal and the square shaft 32. A screw 60 extending through the release lever 38 and threaded into an aperture in the foot pedal 26 compresses a spring 62 against the release lever, urging the lever against the shaft 32 and foot pedal 26.

The release lever 38 includes a metal blocker plate 64 welded to the lever plate 57 in a position to abut the square shaft 32. One end 66 of the blocker plate forms with the lever plate 57 a right angle in which a corner of the square shaft sits when the shaft is in a rest position. The blocker 64 prevents rotation of the square shaft 32 in the clockwise direction when the release lever is not pressed down. When the release lever is pressed down, further compressing the spring 62, the blocker 64 is moved out of the path of rotation of the shaft 32 so that the shaft may be rotated in the clockwise direction to loosen the strap.

In operation, to tighten the strap 30 about a user's foot resting on the foot pedal 26, the user turns the knob 34 in the counterclockwise direction as shown by the arrow 36 to engage the one-way clutch 52. The clutch 52 when engaged, transmits the counterclockwise rotation of the knob 34 to the shaft 32. The corner of the shaft seated, when the shaft is in a rest position, in the right angle formed by the blocker 64 and lever plate 57, forces the release lever 38 down, compressing the spring 62 when the shaft 32 is rotated in the counterclockwise direction. Rotation of the knob 34 in the clockwise direction does not transmit rotation to the shaft 32 due to the one-wa clutch which is disengaged. To loosen the strap 30, the user pushes the release lever 38 down so that the blocker 64 is out of the path of rotation of the shaft 32. The user, by urging his foot up against the strap or by pulling up on the strap with his hand, causes the strap to unwind from the shaft 32, the shaft rotating in the clockwise direction.

It is noted that although the shaft 32 is described as being square so that the blocker 64 can prevent rotation thereof in the clockwise direction, a multi-cornered ratchet assembled into a shaft may instead be used to engage the blocker when an attempt is made to rotate the shaft in the clockwise direction without depressing the release lever. Also it should be noted that operation of the foot pedal assembly including the shaft 32 as described above is for an assembly designed for the right foot. Rotation of the shaft 32 would be in the opposite direction for an assembly designed to secure the left foot.

Figure 6:
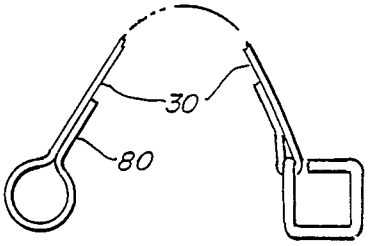
FIG. 6 is an end view of the strap and strap anchor shown in FIG. 3.

The strap 30 is attached at one end to the square shaft 32 by a strap anchor 68 as shown in FIGS. 3, 5 and 6. The strap anchor 68 consists of a cold drawn steel wire formed with parallel coaxial square loops 70 and 72 at opposite ends of the wire, the loops being displaced from one another by a portion 74 of the wire whose length is approximately equal to the width of the strap 30. The strap 30 is wound about the portion 74 of the anchor 68 and sewn or otherwise secured thereto, whereas the shaft 32 extends through the square loops 70 and 72 of the anchor. The perimeter of each of the loops 70 and 72 is slightly greater than the perimeter of a cross section of the square shaft 32 so that the anchor may be easily moved along the length of the shaft to adjust to the size of the user's foot. The loops 70 and 72 are not closed but have a small gap 76, 78 between each tip of the wire ends and each of the loops forming a corner of the loop with the respective tip. Because the loops 70, 72 are not closed, the strap anchor 68 is easier and cheaper to manufacture than if the loops were closed. When the square shaft is rotated in the counterclockwise direction to tighten the strap 30 about a user's foot, the strap as it is wound tightly about the shaft 32 closes the gaps 76 and 78 in the loops. As the gaps in the loops are closed, the loops 70, 72 tighten about the shaft 32 so as to prevent longitudinal movement of the strap anchor 68 along the shaft. Further, the strap anchor 68 is strengthened as the strap 30 closes the gaps 76 and 78 so that a steel wire may be used having a lighter gauge than would typically be required.

The other end 80 of the strap 30 is wound about a fixed shaft 82 extending parallel to the square shaft 32 on the opposite side of the foot pedal 26, the end 80 of the strap 30 being sewn to the strap or otherwise secured about the shaft 82. The strap 30 may be made of any material having a high coefficient of friction so that the strap does not move easily longitudinally along the shaft 82. Preferably, the strap is made of a urethane or a urethane laminated cloth because of urethane's high coefficient of friction, but the strap may also be made of leather or another type of woven material.

According to a second embodiment of the present invention, the strap anchor 68 shown relative to the first embodiment in FIGS. 2–6 is replaced with a spool-end strap anchor assembly 82 as shown with reference to FIGS. 7 and 8. The spool strap anchor assembly 82 includes generally frusto-conical, spool end portions 86 having a square shaped opening 88 extending therethrough. The opening 88 further includes an elongated groove 90 extending parallel therewith along one face of the opening 88. The spool ends 86 are mounted on the shaft 32, with the shaft 32 extending through the square opening 88, for rotation therewith. The perimeter of the opening 88 is larger than the perimeter of the square shaft 32 so that the strap anchor assembly 82 may be easily moved along the length of the shaft 32 to adjust the size of the user's foot. An elongated pin 92 as illustrated in part by the dashed lines in FIG. 8 of, for example, metal, extends through the groove 90 of each spool end 86 and is secured thereto by any known means. In the embodiment shown in FIGS. 7 and 8 the pin 90 is configured with its end portions 93 bent at right angles to the pin axis and the end portions 93 are secured within recessed openings 91 in each of the spool ends 86. The strap 30 is wound about the pin 92 and sewn or otherwise secured to itself as shown in FIG. 8.

When the square shaft 32 is rotated in the counterclockwise direction, as discussed above, to tighten the strap 30 about the user's foot, the spool ends 86 also rotate in a counterclockwise direction causing the strap 30 to be wound about the square shaft 32 between spool ends 82. Conversely, rotating the shaft 32 in the clockwise direction causes similar rotation of the square shaft 82 to unwind or loosen the strap 30. In all other respects, the foot pedal assembly is similar to that discussed above relative to FIGS. 2–6.

Figure 9:
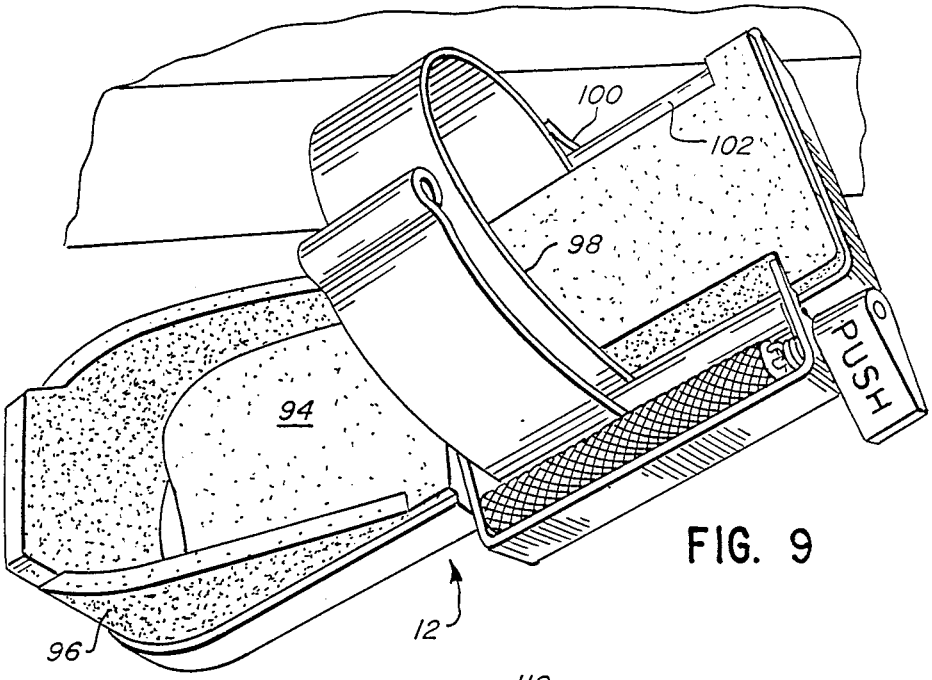
FIG. 9 is a perspective view of a foot pedal assembly according to a third embodiment of the present invention.

In the preferred embodiment of the invention, a foot pedal 12' as shown in FIG. 9, includes a base or foot pedal 94 upon which the user's foot rests. The foot pedal 94 is made of cast aluminum having an upstanding portion 96 against which the back of the user's heel rests. The user's foot is held in place on the foot pedal 94 by a strap 98 which is attached at a looped first end 100 wrapped around a fixed cylindrical shaft 102 parallel to the inside portion of the foot pedal 94. The looped end 100 should have a diameter large enough to permit the strap 98 to slide longitudinally along the shaft 102 when there is no tension on the strap 98. The strap 98 may be made of any material having a high coefficient of friction so that when the strap is under tension it does not move easily longitudinally along the shaft 102. Preferably, the strap is made of a urethane or a urethane laminated cloth because of urethane's high coefficient of friction, but the strap may also be made of leather or another type of woven material.

Figure 10:
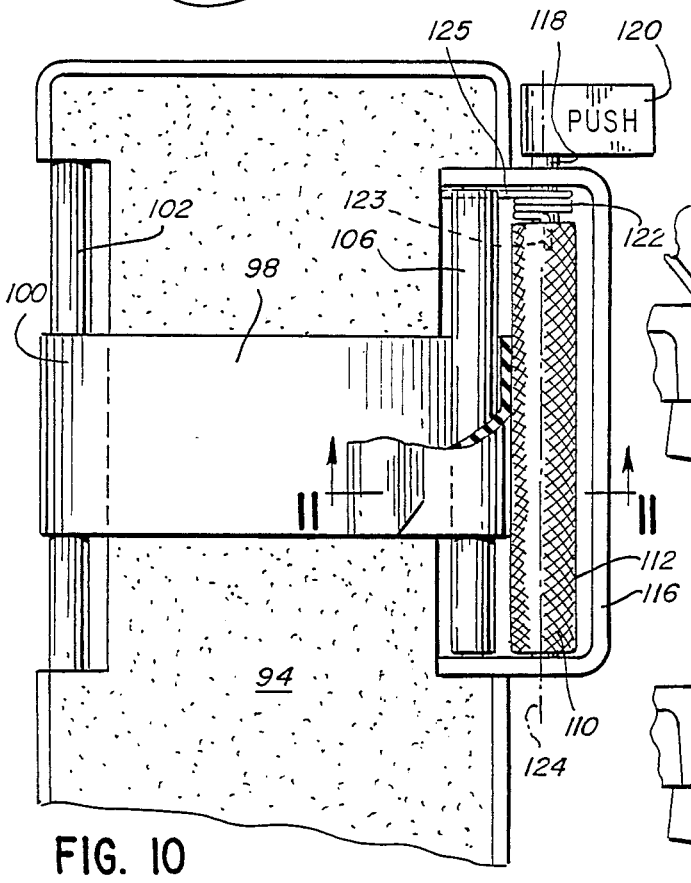
FIG. 10 is a top view, partially in cross section, of the foot pedal assembly of FIG. 9.
Figure 11A:
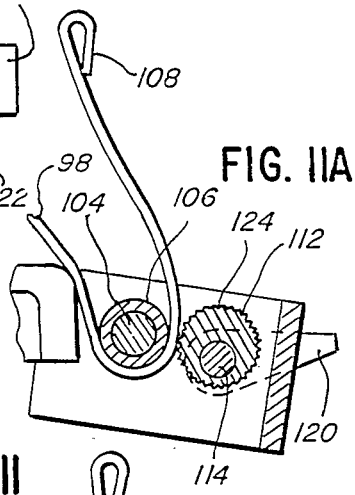
FIGS. 11A and 11B are cross-sectional views taken along lines 11—11 of FIG. 10 with the locking cam in different positions in each view.

Referring also to FIGS. 10 and 11, a second fixed cylindrical shaft 104 extends parallel to the first fixed shaft 102 on the opposite side of the foot pedal 94. A concentric cylindrical sleeve 106 is coaxial with and rotatably carried by the second fixed shaft 104. The strap 98 is wrapped, as shown in FIGS. 10 and 11, around a portion of the sleeve 106. Accordingly, the tightness of the strap 98 about a user's foot can be increased by pulling on a looped end 108 of the strap 98.

An eccentric locking angle cam 110 includes an off-centered knurled or other friction enhancing surface cylindrical shaft 112 carried by a centered cylindrical rotational shaft 114 as an integral part of eccentric cam 110. The shaft 114 is received in suitable openings (not shown) in a U-shaped bar 116 having similar openings (not shown) for receiving the second fixed shaft 104 to secure the bar 116 to the foot pedal 94. The cam 110 is mounted with its rotational shaft 114 parallel to the second fixed shaft 104. One end 118 of the shaft 114 includes an outwardly extending lever 120 secured thereto. A return spring 122 surrounds the support shaft 114 and is received at one end 123 thereof in an end opening (not shown) in the knurled shaft 112. A second end 125 of the spring 122 engages the rotatable shaft 104. Accordingly, the force of the spring 122 normally urges the cam 110 in a counterclockwise direction. If the lever 120 is depressed downwardly against the force of the spring 122, then the shaft 114 and thus the cam 110 is rotated in the clockwise direction.

Figure 11B:
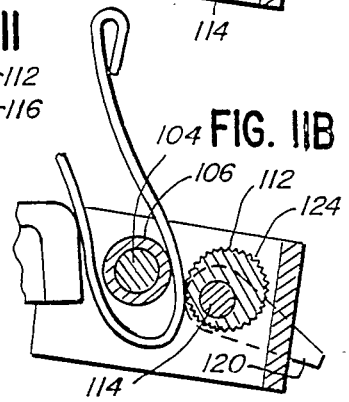

The axial spacing between the rotating sleeve 106 and eccentric shaft 112 is determined so that it is less than the sum of the strap thickness, the radius of the rotatable sleeve 106 and the radius of the shaft 114 above which line of eccentricity 124 is described. As is obvious, the line of eccentricity represents the outer portion of the knurled shaft 112 which is furthest away from the rotational axis. As a result of this spacing, the spring 122 urges the cam 110 so that the line of eccentricity 124 is directed towards the cylindrical shaft 106 to limit the space therebetween and to cause the strap 98 to be wedged therebetween as illustrated particularly in FIG. 11A. Depressing the lever 120, as shown in FIG. 11B, moves the line of eccentricity away from the cylindrical sleeve 106. This movement results in the spacing between the cam 110 and the cylindrical sleeve 106 increasing to an amount greater than the thickness of the strap 98, allowing for movement of the strap 98 between the cam 110 and the sleeve 106.

As a result of the physical relationship between the cylindrical sleeve 106 and the cam 110, discussed above, when the second end 108 of the strap 98 is pulled on, the friction between the strap and the knurled shaft 112 causes the cam 110 to rotate in the clockwise direction against the force of the spring 122. The clockwise rotation of the cam 110 moves the line of eccentricity 124 away from the sleeve 106, allowing the strap 98 to be further pulled around the cylindrical sleeve 106 to tighten the strap 98 relative to a user's foot. However, if the strap 98 is pulled on at a point between its first end 100 and the portion wound about the cylindrical sleeve 106, in an attempt to loosen the strap 98, the friction between the strap 98 and the knurled shaft 112 rotates the cam 110 in the counterclockwise direction which draws the line of eccentricity 124 towards the cylindrical sleeve 106 to further wedge the strap 98 between the cam 110 and the cylindrical sleeve 106 to further tighten the engagement of the belt therebetween and prevent loosening. Accordingly, the strap can only be loosened by depressing the push lever 120, as discussed above, and not by outward pressure extended by a user's foot during an exercise routine.

We claim:

1. In an exercise machine, a foot pedal assembly for securely maintaining a user's foot in place while the user operates the machine comprising:

a foot pedal having a longitudinally extending upper surface on which the user's foot may rest;

first and second parallel fixed shafts coupled to opposite sides of the foot pedal;

a strap having first and second ends, the first end being coupled to the first fixed shaft and extending horizontally across the upper surface of the foot pedal in a position to maintain the user's foot in place on the pedal;

a concentric shaft coaxial with the second fixed shaft and rotatable with respect thereto;

an eccentric cam shaft having an off-center pivotal axis defining a line of eccentricity thereon; and means coupled to said second fixed shaft and said cam shaft for mounting said cam shaft in parallel spaced relation to said concentric shaft, said strap being partially wound about said concentric shaft so that said cam shaft forces said strap against said concentric shaft to allow movement of said strap in only one direction.

2. The foot pedal assembly of claim 1 further comprising means for rotating said cam shaft to further space said cam shaft away from said concentric shaft to permit bidirectional movement of said strap relative thereto.

3. The foot pedal assembly of claim 1 wherein the spacing between pivoting centers of said concentric shaft and said cam shaft is less than the sum of the thickness of said strap, the radius of the concentric shaft and the radius of the cam shaft at its line of eccentricity.

4. The foot pedal assembly of claim 2 wherein said rotating means comprises a lever secured to said cam shaft.

5. The foot pedal assembly of claim 2 further comprising a return spring engaging said cam shaft for urging said cam shaft so that its line of eccentricity is proximate to said cylindrical shaft.

6. The foot pedal assembly of claim 1 wherein said cam shaft comprises a knurled increase friction between the cam shaft and the surface to limit relative movement therebetween.

7. The foot pedal assembly of claim 1 wherein said strap is made of a material having a high coefficient of friction.

* * * * *